US005604936A

United States Patent [19]

Mausolf

[11] Patent Number: 5,604,936

[45] Date of Patent: Feb. 25, 1997

[54] SELF-LOWERING TOILET SEAT

[76] Inventor: Melvin J. Mausolf, 11 Claremont Dr., Flat Rock, N.C. 28731

[21] Appl. No.: 535,640

[22] Filed: Sep. 28, 1995

[51] Int. Cl.[6] ..... A47K 13/10

[52] U.S. Cl. ..... 4/246.1; 4/246.2; 188/302; 188/305

[58] Field of Search ..... 4/246.1, 246.2, 4/246.3, 246.4, 246.5, 248; 188/297, 302, 305, 311; 16/58, 66

[56] References Cited

U.S. PATENT DOCUMENTS

| | | | |
|---|---|---|---|
| 1,743,079 | 1/1930 | Burkett et al. . | |
| 1,830,361 | 11/1931 | Humphries . | |
| 1,993,625 | 3/1935 | Riemer et al. | 4/248 |
| 2,104,947 | 1/1938 | Joosten . | |
| 2,474,164 | 6/1949 | Riemer et al. | 4/248 |
| 3,289,636 | 12/1966 | Tessier . | |
| 3,289,637 | 12/1966 | Tessier . | |
| 3,333,740 | 8/1967 | Waller . | |
| 3,548,443 | 12/1970 | Rassa | 188/305 |
| 3,781,924 | 1/1974 | Davis, Jr. . | |
| 4,195,372 | 4/1980 | Farina . | |
| 5,101,518 | 4/1992 | Phillips . | |
| 5,153,946 | 10/1992 | Yoke et al. . | |
| 5,193,230 | 3/1993 | Guerty . | |
| 5,267,356 | 12/1993 | Gideon et al. . | |
| 5,279,000 | 1/1994 | Mercier et al. . | |
| 5,343,571 | 9/1994 | Guerty . | |

FOREIGN PATENT DOCUMENTS

| | | | |
|---|---|---|---|
| 3718705 | 12/1988 | Germany | 4/248 |

*Primary Examiner*—Henry J. Recla
*Assistant Examiner*—Charles R. Eloshway
*Attorney, Agent, or Firm*—Hoffman, Wasson & Gitler

[57] ABSTRACT

An automatic lowering mechanism for a toilet seat comprises a device for translating the rotational movement of the toilet seat into a lateral movement which is used in conjunction with a pneumatic compression cylinder to retard the descent of the toilet seat so that it comes to gently rest upon a toilet bowl. This mechanism for translating the motion of the toilet seat from a rotary to a lateral motion as well as the pneumatic compression cylinder can easily be replaced without removal of the entire automatic toilet seat lowering mechanism.

20 Claims, 4 Drawing Sheets

SELF-LOWERING TOILET SEAT

BACKGROUND OF THE INVENTION

1. Field of the Invention

The present invention relates to the field of self-lowering toilet seats.

2. Description of the Prior Art

Most toilets designed to be used in a standard residential bathroom include a toilet seat as well as a toilet seat lid which are hingedly attached to the top surface of the commode to allow the lid and seat to be manually raised and lowered. The seat is generally maintained in the lowered position except when a male utilizes the toilet as a urinal. If the toilet is used as a urinal, with the toilet seat raised, it could cause problems when a female wishes to use the toilet and the male fails to lower the toilet seat. This is particularly a problem during the evening or night when it is dark and the female is tired, and does not realize that the toilet seat is in the raised position.

A number of devices have been proposed to eliminate this problem by automatically lowering the toilet seat after each use as a urinal with the toilet seat in the raised position. Typical of these devices of are those described in U.S. Pat. No. 3,781,924 issue to Davis, Jr.; U.S. Pat. No. 5,153,946 issued to Yoke et al.; U.S. Pat. No. 5,193,230 issued to Guerty; U.S. Pat. No. 5,267,356 issue to Gideon et al.; and U.S. Pat. No. 5,279,000 issued to Mercier et al. For example, the Yoke et al. patent describes an apparatus and method for automatically closing a toilet lid and seat. This apparatus includes a control mechanism engageable with the seat employing a timing mechanism to release the seat from the raised position. This mechanism is relatively complicated and expensive and might prove to be annoying or inadequate if the male has not completed his urination when the timer releases the seat.

The patent to Gideon et al. describes a commode seat lowering apparatus which is tied into the water line and requires the toilet to be flushed to operate the lowering apparatus. Since an apparatus must be tied to the water line before it would operate properly, it would therefore require a relatively difficult installation step. Furthermore, if the seat is raised and the toilet is not flushed, it would remain in the raised position.

The patent to Guerty describes an automatic toilet seat lowering apparatus which includes a descent initiator activated when an internal cavity is filled with pressurized water. Similar to the Gideon et al. patent, a line must be utilized connecting a water supply to the toilet seat lowering apparatus.

The patent to Mercier et al. describes an automatic toilet seat apparatus which operates utilizing a hydraulic dampening mechanism. This mechanism is relatively expensive to manufacture, and due to its complexity, would require a large amount of maintenance.

SUMMARY OF THE INVENTION

The deficiencies of the prior art are addressed by the present invention which is directed to an automatic mechanism for lowering a toilet seat. This invention utilizes the weight of the toilet seat itself, as the main driving force for the lowering of the toilet seat. The seat is initially raised by the user to a point slightly less than 90° with respect to the horizontal (i.e. close to the vertical position). During urination, the male would hold the toilet seat with one hand. Upon completion of his urination, the male would release his hold on the toilet seat which would then automatically be lowered to a horizontal position over the toilet bowl rim. The toilet seat lowering device includes one or more pneumatic cylinders, each of which is attached to the toilet seat and the toilet bowl. Rotation of the lowering device, or a portion thereof, would be translated to a shaft which would move in a lateral direction. The shaft is connected to a piston provided within a sealed cylinder which would operate to control the rate of descent of the toilet seat, ensuring that the seat does not contact the toilet bowl with undue force. A variable sized orifice is used to control the rate of descent of the toilet seat. The lowering mechanism is designed to allow replacement of the pneumatic cylinder as well as the shaft and gearing arrangement which translates the rotational movement of the toilet seat to a lateral movement which operates the pneumatic cylinder, without the necessity of replacing the entire toilet seat lowering apparatus.

Alternatively, the speed of descent can be slowed dramatically by reducing the air flow through the variable sized orifice, from the pneumatic cylinder. Thus, with reduced air flow, the male could release the seat after raising it and have sufficient time to urinate before the seat would approach or pass into the line of urination.

BRIEF DESCRIPTION OF THE DRAWINGS

Various other objects, features, and advantages of the present invention will be more fully appreciated as the invention becomes better understood when considered in conjunction with the accompanying drawings, in which like reference characters designate the same or similar parts throughout the several views, and wherein.

DESCRIPTION OF THE PREFERRED EMBODIMENT

Figure 2:
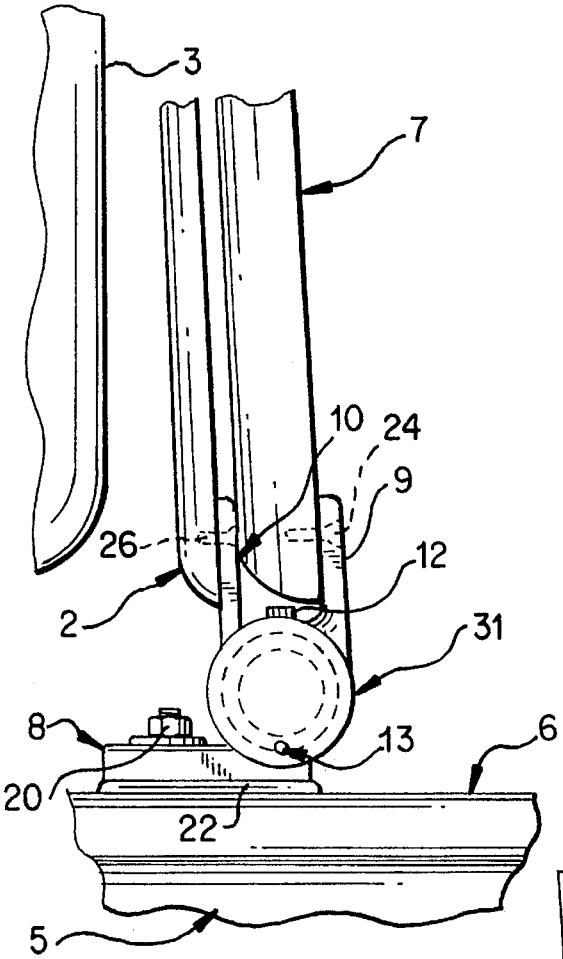
FIG. 2 is a side view of the present invention with the toilet seat raised to a level slightly greater than vertical.

Referring particularly to FIGS. 1–5, the automatic toilet seat lowering device 1 includes a relatively cylindrically configured lowering apparatus 31, and a descent dampening device which is affixed to a toilet bowl 5 and toilet seat 7. The toilet seat lowering mechanism 31 consists primarily of sections 11, 17, 27, and 28 which are each adjacent to one another. Section 27 is rotatable and is attached to a toilet seat mounting bracket 9. A bolt 24 is provided proximate to the end of the bracket 9 and is used to attach a toilet seat 7 thereto as shown in phantom in FIGS. 4 and 5 as well as in FIGS. 1, 2, and 3. It is noted that other suitable means of connection can be utilized to removably attach the automatic toilet seat lowering mechanism 1 to the toilet seat 7. When the mechanism 1 is properly in place, the raising or lowering of seat 7 would cause section 27 to rotate.

If the entire toilet seat assembly includes a seat cover or lid 2, it could be attached to the automatic toilet seat lowering mechanism utilizing a bracket 10, and a bolt 26. The bracket 10 is attached to the rotating collar section 17 which would allow the toilet seat cover 2 to be raised or lowered. Rotation of the cover 2 would cause the rotating collar section to rotate. However, it should be noted that even if a cover or lid 2 is included, it need not be attached to the apparatus 31 for the apparatus 31 to properly operate.

Figure 1:
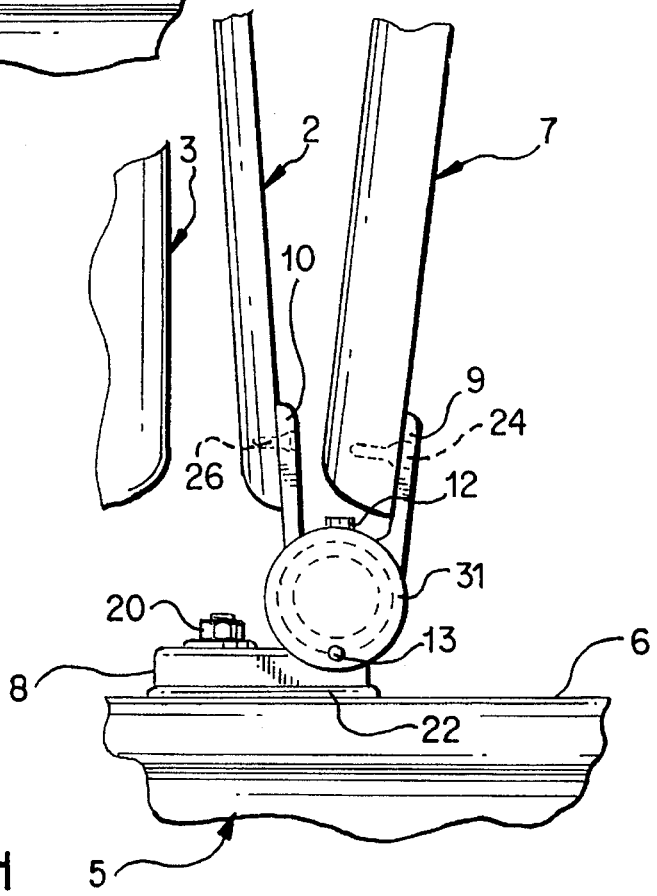
FIG. 1 is a side view of the invention with the toilet seat raised to a level slightly short of vertical.

The automatic toilet bowl lowering mechanism is provided with a non-rotating section located between rotating sections 17 and 27. This section 28 is directly mounted to a flat section of the toilet bowl 5 utilizing mounting assembly 8. This mounting assembly includes a toilet seat mounting bracket base 22 as well as an attachment bolt 20. As was true with the fixation of the brackets 9 and 10 to the toilet seat 7 and toilet seat cover 2 respectively, various means of rigidly affixing the automatic toilet seat lowering assembly to the toilet bowl 5 can be utilized. As shown in FIGS. 1 and 2, the automatic toilet seat lowering mechanism 31 is provided on a flat surface between the toilet bowl rim 6 and the flush water tank 3.

Figure 3:
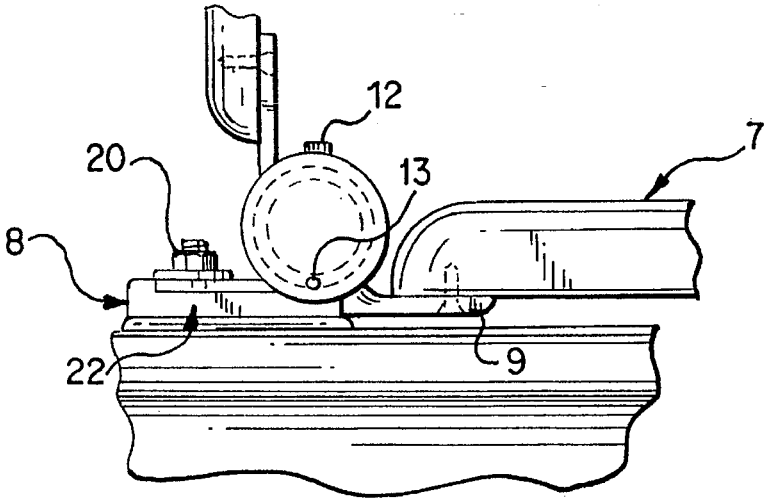
FIG. 3 is a side view of the invention with the toilet seat in the horizontal position.

FIGS. 1–3 show the positioning of the toilet seat cover 2 and the toilet bowl seat 7 in various positions. FIG. 1 illustrates the automatic toilet seat lowering mechanism when the seat 7 is raised to a position slightly less than vertical (i.e. 85°). In this position, a male would hold the toilet seat 7 in position until he is finished urinating. At this time, the male would release the seat, and, through the use of gravity, it would begin to lower until it reaches the horizontal position shown in FIG. 3.

Alternatively, the speed of descent can be slowed dramatically by reducing the air flow through the variable sized orifice, from the pneumatic cylinder. Thus, with reduced air flow, the male could release the seat after raising it and have sufficient time to urinate before the seat would approach or pass into the line of urination.

As will be explained later, the present invention includes a device for disengaging the automatic lowering toilet seat from use. When this is accomplished, the toilet seat 7 and the lid 2 can both be raised to a position which is slightly greater than vertical (i.e. approximately 95°), as shown in FIG. 2.

Figure 4:
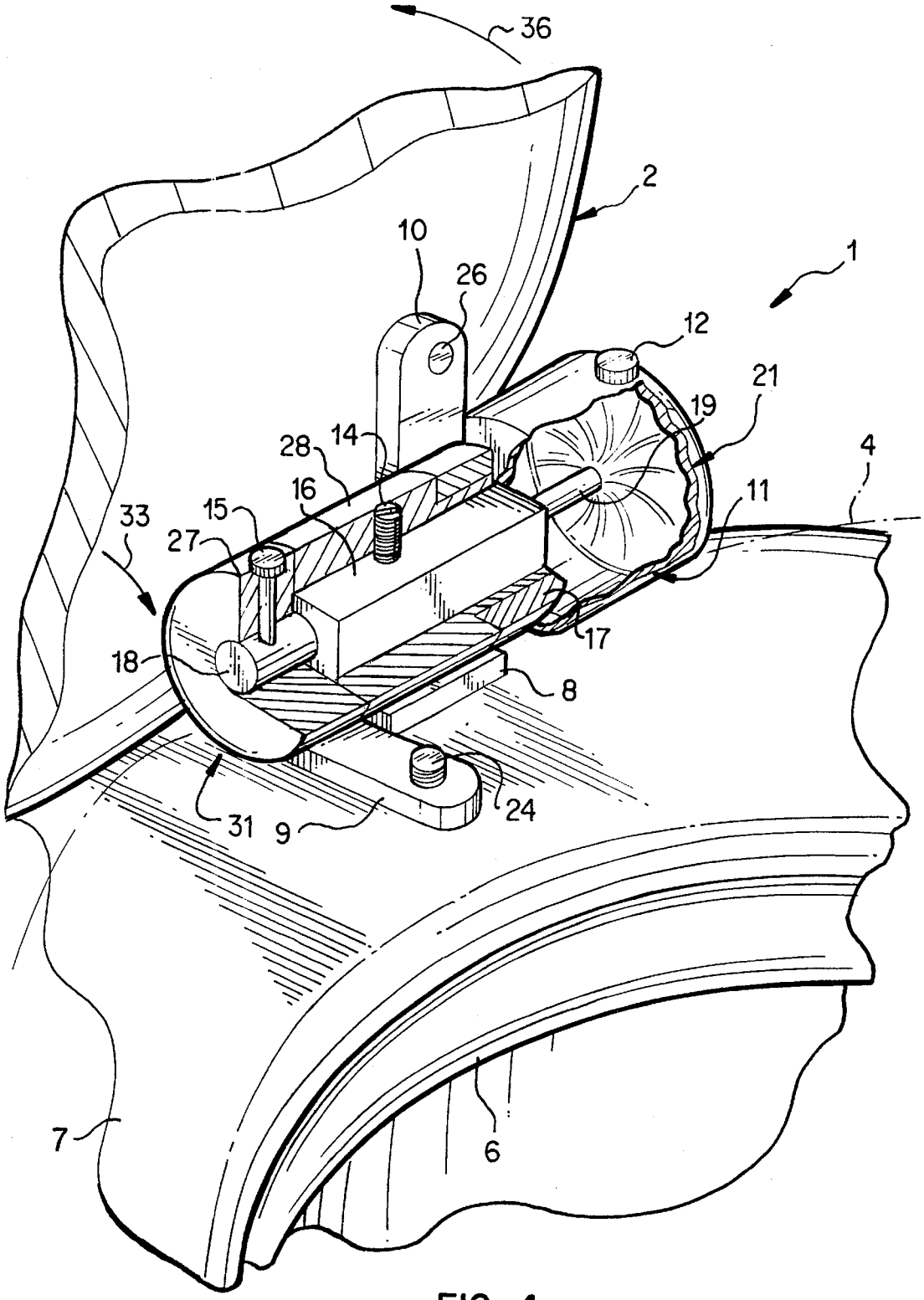
FIG. 4 is an enlarged, fragmentary view of the toilet seat lowering mechanism according to the present invention.
Figure 6:
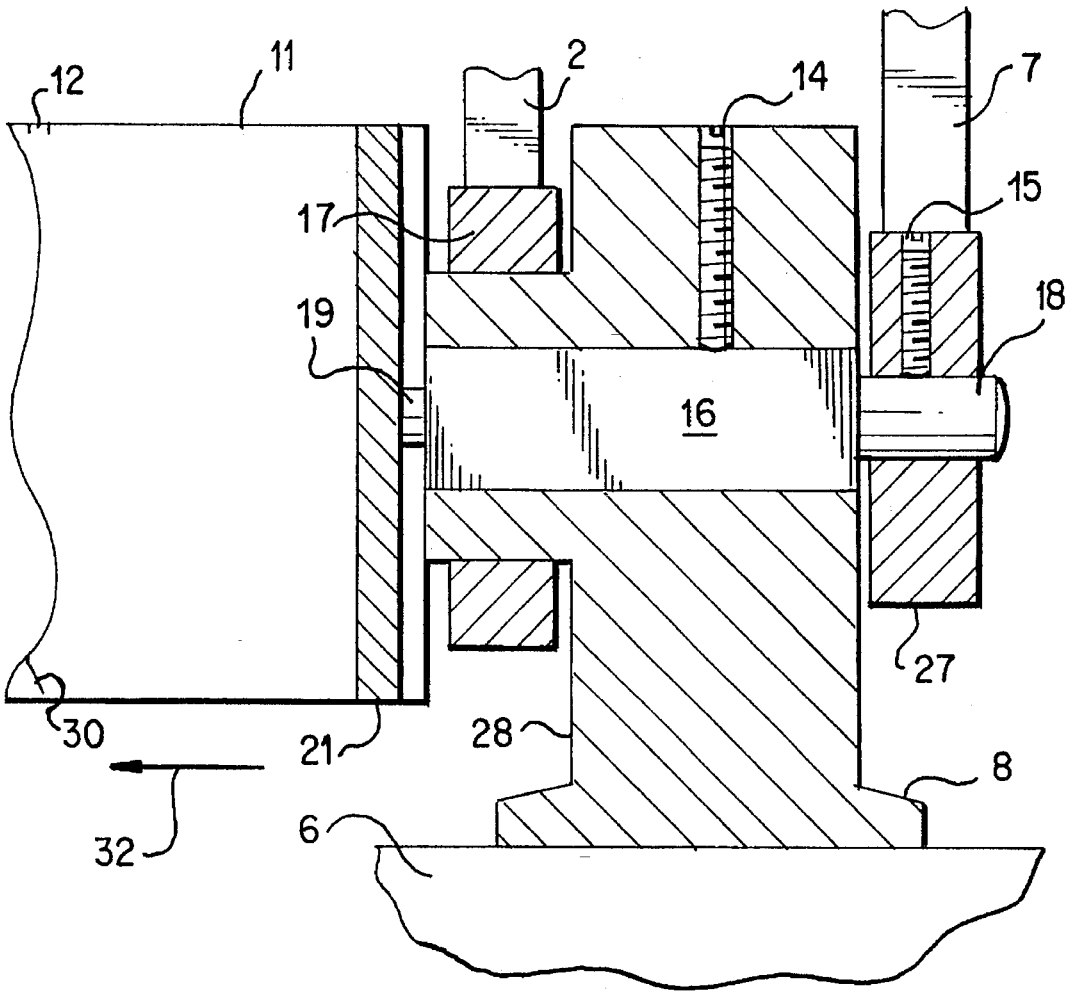
FIG. 6 is a schematic view of the toilet seat lowering mechanism.

FIG. 4 illustrates a fragmentary view of the automatic toilet seat lowering mechanism 31. Since the mechanism operates utilizing the weight of the toilet seat 7, as well as gravity, it is important that the rate of the descent of the toilet seat be controlled to insure that it does not descend at a speed which would create a loud noise when the toilet seat 7 reaches the horizontal position as shown in FIG. 2. Additionally, a failure to halt the speed of descent could result in damage to both the toilet bowl 5, toilet 6, as well as the seat 7. To this end, the present invention utilizes a sealed pneumatic compression cylinder 11 which lies adjacent to the freely rotating seat cover collar section 17. The cylinder is provided with a piston 21 connected to a piston shaft 19. It is noted that the toilet seat 7 shown in phantom 4 is at its fully lowered position. Consequently, the piston 21 is shown at a position relatively far removed from the rotating collar 17. This should be contrasted with the piston as shown in FIG. 6 which illustrates the piston close to the rotating collar 17. At this position, the toilet seat 7 should be in the raised position.

The rate of descent of the present invention is controlled utilizing a pneumatic cylinder as best illustrated in FIGS. 4 and 6. These figures show a mechanism for translating the rotational movement of section 27 into a lateral movement. This mechanism includes a shaft 18 connected to one side of a gearing mechanism provided within a rectangular casing 16. The second side of this gearing mechanism is connected to the laterally moving piston shaft 19 provided with the piston 21 at one end. The shaft 18 is provided within section 27 of the automatic toilet seat lowering device. A quick release pin 15 connects the rotational movement of section 27 with the shaft 18. A hole within the surface of the shaft 18 is provided to allow the quick release of pin 15 to transfer the rotational movement of section 27 to rotational movement of the shaft 18. Consequently, removal of the quick release pin 15 would convert the toilet seat to the non-automatic mode for normal toilet cleaning, or to replace the mechanism. The automatic mode is easily returned by snapping the pin 15 back in place into the hole of the shaft 18.

The rectangular gear shaft 16 is provided within the interior of non-moveable section 28 including a hub provided under the rotating collar section 17. Rotating collar section 17 rotates freely around this hub. The interior of these sections would be configured to allow placement of the rectangular gear case 16 therein. This casing would convert the rotational movement of shaft 18 into a lateral movement similar to the operation of a mechanical pencil or similar device in which rotational movement at one end would be converted to lateral movement at a second end. U.S. Pat. Nos. 3,289,636 and 3,289,637 issued to Tessier, and U.S. Pat. No. 3,333,740 issued to Waller all describe this type of mechanical translation and are hereby incorporated by reference. The end of the rectangular gearing casing 16 opposite to that of the shaft 18 is connected to the sealed pneumatic compression cylinder 11. This cylinder includes the horizontal piston shaft 19 which would move in a lateral direction. This piston shaft is connected to the piston 21. The pneumatic compression cylinder is sealed at the end closest to the gear casing utilizing an O-ring, bushing, or similar sealing device. As particularly shown in FIG. 5, the cylinder 11 is provided with an air-compression outlet 12 as well as an air suction inlet 13 provided on the outside surface 36 of cylinder 11. Therefore, as the piston 21 moves in the direction of arrow 32 shown in FIG. 6, compression of the air within the compression cylinder 11 would slow the movement of the shaft 19 toward the end 36 of the cylinder 11. This reduction of the speed of movement of the piston 21 and consequently of the shaft 19 would reduce the speed of rotating shaft 18, and therefore section 27, thereby forcing the speed the descent of the toilet seat 7 to be reduced.

When the toilet seat 7 begins to fall from its upraised position shown in FIG. 1, section 27 of the automatic toilet seat lowering mechanism would rotate in the direction of arrow 33 in FIG. 4. This rotational movement is transferred to shaft 18 through pin 15. Gearing provided within the casing 16 would then translate this rotational movement into a lateral movement of the shaft 19 and piston 21 in the direction of arrow 32 shown in FIG. 6. The piston 21 would force air out of the air compression outlet 12 which would then slow the descent of the toilet seat 7 so that it gently contacts the toilet bowl rim 6. Typically, the pneumatic compression cylinder 11 can be in the range of 1.5 to 2.0 inches in diameter and have a piston stroke of similar dimensions. It is noted that these dimensions must be compatible with standard toilet bowl dimensions and configuration. Rotational movement of the toilet seat of about 85° to 88° would rotate the shaft 18 and cause the piston in the cylinder to move approximately 1.5 to 2.0 inches. The air inlet 13 is covered by a flap valve 30. Movement of the piston 21 in direction shown by arrow 32 illustrated in FIG.

6 would force the flap valve 30 closed. Movement of the piston 21 in the direction opposite the arrow 32 would cause the flap valve 30 to open to allow air to enter.

Figure 7:
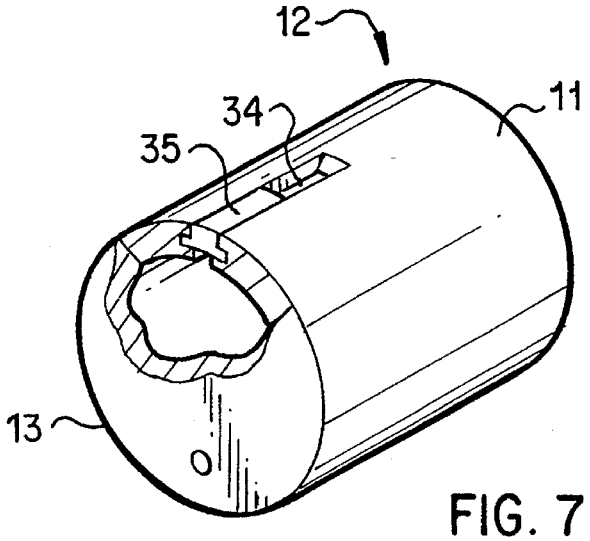
FIG. 7 is an exploded view of the variable orifice used in conjunction with the present invention.

Since the size and weight of many toilet seats are different, it is important to be able to control the rate of descent of the toilet seat 7 without markedly changing the design of the apparatus 31. Consequently, the air compression outlet 12 would preferably be provided with a variable orifice. Although many types of devices for automatically or manually changing the size of the orifice can be envisioned, FIG. 7 illustrates one type of construction. As illustrated, FIG. 7 includes an orifice 34 which is currently in the opened position. The size of this opening can be reduced or completely closed utilizing a slide valve 35. Obviously, for any particular toilet seat 7, the greater the size of the uncovered orifice 34, the faster the toilet seat will descend.

Figure 5:
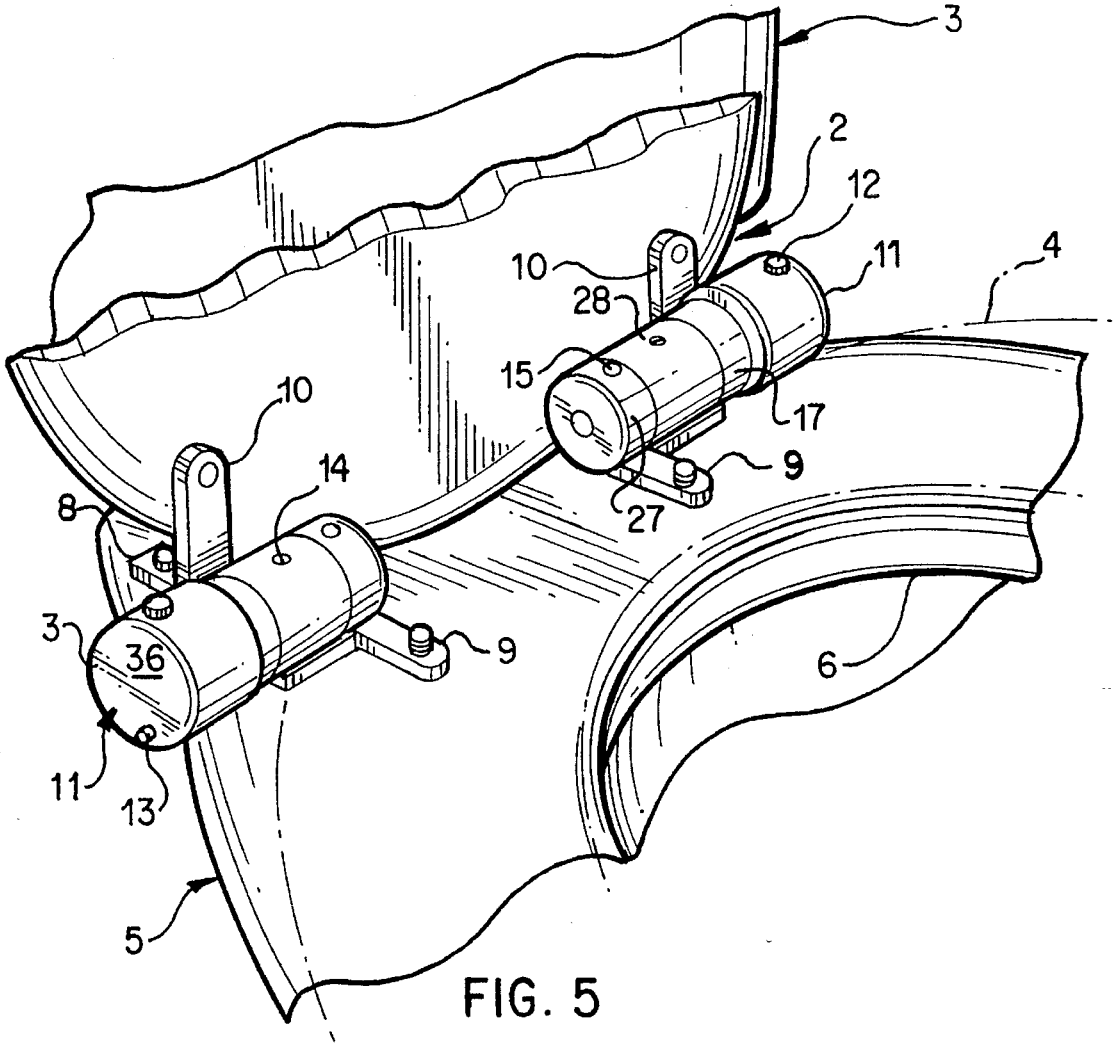
FIG. 5 is a perspective view of two seat lowering mechanisms installed on a toilet bowl.

Although the present invention can operate utilizing a single automatic toilet seat lowering mechanism employing a single pneumatic compression cylinder, it is possible to utilize two automatic toilet seat lowering devices and pneumatic compression cylinders as illustrated in FIG. 5.

The automatic toilet seat lowering device can be installed as follows: appropriate holes are drilled into the toilet seat 7 as well as the seat cover 2. Additionally, a hole is drilled into the toilet bowl 5. Utilizing bolt 24, section 27 is secured to the toilet seat 7 through bracket 9. The immoveable section 28 is then affixed to the toilet bowl side utilizing bolt 20. Since it is unimportant whether condensation or other debris enter any gap which is formed between sections 27 and 28, these two sections need not be sealed with respect to one another. It is only important that section 27 should be able to freely rotate. A tolerance of perhaps, 1/64th of an inch would be appropriate. Next, rotating section 17 is secured to the cover 2 utilizing a bolt 26 and the bracket 10. Similar to the affixation of section 28 with respect to section 27, it is not important that the rotating collar 17 be sealed with respect to section 28 and a tolerance of approximately 1/64th would be appropriate. The sealed cylinder 11 containing the horizontal shaft 19 and piston 21 therein is connected to the casing 16 and the shaft 18. Openings are provided in sections 27 and 28 to allow the shaft 18 and the casing 16 to be slid in the opposite direction to that shown by arrow 32 in FIG. 6. When these mechanisms are in place, a set screw 14 is inserted through section 28 and cooperates with a hole provided in the surface of the gear casing 16 to hold this assembly in place. The quick release pin 15 is then inserted into section 27 and cooperates with the hole provided on the surface of shaft 18. It is noted that the shaft 18 need not be smooth, but, due to the use of the pin 15, it could exhibit a smooth outer surface.

It is also noted that the particular configuration utilized by the present invention would not require that the entire automatic toilet seat lowering mechanism be replaced if the unit malfunctions. More than likely, any malfunction would be due to a problem in the compression cylinder 11 or the gear casing 16. If this should occur, removal of the quick release pin 15 and the set screw 14 would allow the compression cylinder 11, the gear casing 16, and the shaft 18 to be removed. In this instance, a new unit including the compression cylinder 11, gear casing 16, and shaft 18 can be inserted. Replacement of the quick release pin 15 as well as the set screw 14 would complete the replacement process. Therefore, removal of sections 27 and 28 as well as the rotating collar 17 from the toilet seat 7, the bowl 5, and the cover 2 would not be necessary.

In operation, if the quick release pin is in place, when a male wishes to use the toilet as a urinal, the male would raise the toilet seat 7 to the position shown in FIG. 1, which would be approximately 5° short of vertical. The toilet seat 7 would be held in place, and after urination is completed, he would release the toilet seat 7. At this point, through the use of the weight of the toilet seat 7 as well as gravity, the seat would begin to lower. Rotation of the seat 7 would result in rotation of section 27. This rotation would be transferred to shaft 18 which would translate this rotational motion into a lateral movement of the piston shaft 19, through the gearing provided in casing 16. The piston 21 would then move in the direction shown by arrow 32. The pneumatic compression cylinder 11 would then act to slow the descent of the toilet seat 7 by slowing the movement of the piston shaft 19 in the direction of arrow 32. This would result in slowing the rotation of shaft 18, section 27, and consequently the toilet seat 7.

The presently disclosed embodiments of the present invention are to be considered in all respects as to be illustrative and not restrictive, the scope of the invention being indicated by the appended claims, rather that the foregoing description, and all changes which come within the meaning and range of equivalency of the claims are therefore intended to be embraced therein.

What is claimed is:

1. An apparatus for automatically lowering a toilet seat from a raised position to a lowered position adjacent a toilet bowl rim, comprising:

a first cylindrically shaped rotatable section;

a fluid-filled pneumatic cylinder located adjacent to said first cylindrically shaped rotatable section, said cylinder provided with a horizontal shaft and a piston connected to said horizontal shaft for lateral movement within said cylinder;

an air compression outlet provided in said pneumatic cylinder;

first attachment means for attaching said first cylindrically shaped rotatable section to the toilet seat, allowing said first cylindrically shaped section to rotate when the toilet seat is raised or lowered;

a rotatable shaft provided within said first cylindrically shaped section and axially aligned with said horizontal shaft;

a means provided between said first cylindrically shaped section and said rotatable shaft, allowing said rotatable shaft to rotate responsive to rotation of said first cylindrically shaped section; and gearing provided between said rotatable shaft and said horizontal shaft for translating rotational movement of said rotatable shaft to a lateral movement of said horizontal shaft; wherein movement of the toilet seat from a raised position to a lowered position would cause the fluid in said pneumatic cylinder to be compressed by the lateral movement of said piston, thereby resulting in reducing the lateral speed of said piston and the rotational speed of said rotatable shaft and said first cylindrically shaped rotatable section, consequently reducing the speed of descent of the toilet seat.

2. The apparatus for automatically lowering a toilet seat in accordance with claim 1, further including a means for changing the size of said air compression outlet.

3. The apparatus for automatically lowering a toilet seat in accordance with claim 2, wherein said means for changing the size of said air compression outlet includes a manually operated slide member.

4. The apparatus for automatically lowering a toilet seat in accordance with claim 3, further including a non-rotatable section provided between said first cylindrically shaped section and said fluid-filled pneumatic cylinder, said gearing provided within said non-rotatable section.

5. The apparatus for automatically lowering a toilet seat in accordance with claim 4, wherein said gearing and said non-rotatable section are provided with aligned holes and a set screw provided between said holes for securing said gearing in place, further where said pneumatic cylinder, said rotatable shaft and said gearing can be removed from said toilet bowl rim and disengaged from each other by removing said set screw and said means provided between said first cylindrically shaped rotatable section and said rotatable shaft.

6. The apparatus for automatically lowering a toilet seat in accordance with claim 1, further including an air suction inlet provided in said pneumatic cylinder.

7. The apparatus for automatically lowering a toilet seat in accordance with claim 6, wherein said air suction inlet includes a flap valve.

8. The apparatus for automatically lowering a toilet seat in accordance with claim 1, further including a non-rotatable section provided between said first cylindrically shaped rotatable section and said fluid-filled pneumatic cylinder, said gearing provided within said non-rotatable section.

9. The apparatus for automatically lowering a toilet seat in accordance with claim 8, wherein said gearing and said non-rotatable section are provided with aligned holes and a set screw is provided between said holes for securing said gearing in place, further wherein said pneumatic cylinder, said rotatable shaft and said gearing can be removed from said toilet bowl rim and disengaged from each other by removing said set screw and said means provided between said first cylindrically shaped rotatable section and said rotatable shaft.

10. The apparatus for automatically lowering a toilet seat in accordance with claim 1, wherein said means provided between said first cylindrically shaped section and said rotatable shaft is a quick release pin.

11. An apparatus used in conjunction with a toilet seat lid for automatically lowering a toilet seat from a raised position to a lowered position adjacent a toilet bowl rim, comprising:

a first cylindrically shaped rotatable section;

a second cylindrically shaped rotatable section;

a fluid filled pneumatic cylinder located adjacent to said second cylindrically shaped rotatable section, said cylinder provided with a horizontal shaft and a piston connected to said horizontal shaft for lateral movement within said cylinder;

an air compression outlet provided in said pneumatic cylinder;

first attachment means for attaching said first cylindrically shaped rotatable section to the toilet seat, allowing said first cylindrically shaped section to rotate when the toilet seat is raised or lowered;

a second attachment means for attaching said second cylindrically shaped rotatable section to the toilet seat lid, allowing said second cylindrically shaped section to rotate when the toilet seat lid is raised or lowered;

a rotatable shaft provided within said first cylindrically shaped section and axially aligned with said horizontal shaft;

a means provided between said first cylindrically shaped rotatable section and said rotatable shaft, allowing said rotatable shaft to rotate responsive to rotation of said first cylindrically shaped section; and gearing provided between said rotatable shaft and said horizontal shaft for translating rotational movement of said rotatable shaft to a lateral movement of said horizontal shaft; wherein movement of the toilet seat from a raised position to a lowered position would cause the fluid in said pneumatic cylinder to be compressed by the lateral movement of said piston, thereby resulting in reducing the lateral speed of said piston and the rotational speed of said rotatable shaft and said first cylindrically shaped rotatable section, consequently reducing the speed of descent of the toilet seat.

12. The apparatus for automatically lowering a toilet seat in accordance with claim 11, further including a means for changing the size of said air compression outlet.

13. The apparatus for automatically lowering a toilet seat in accordance with claim 12, wherein said means for changing the size of said air compression outlet includes a manually operated slide member.

14. The apparatus for automatically lowering a toilet seat in accordance with claim 13, further including a non-rotatable section provided between said first cylindrically shaped rotatable section and said second cylindrically shaped rotatable section, said gearing provided within said non-rotatable section, and said second cylindrically shaped rotatable section.

15. The apparatus for automatically lowering a toilet seat in accordance with claim 14, wherein said gearing and said non-rotatable section are provided with aligned holes and a set screw is provided between said holes for securing said gearing in place, further where said pneumatic cylinder, said rotatable shaft and said gearing can be removed from said toilet bowl rim and disengaged from each other by removing said set screw and said means provided between said first cylindrically shaped rotatable section and said rotatable shaft.

16. The apparatus for automatically lowering a toilet seat in accordance with claim 11, further including an air suction inlet provided in said pneumatic cylinder.

17. The apparatus for automatically lowering a toilet seat in accordance with claim 16, wherein said air suction inlet includes a flap valve.

18. The apparatus for automatically lowering a toilet seat in accordance with claim 11, further including a non-rotatable section provided between said first cylindrically shaped rotatable section and said second cylindrically shaped rotatable section, said gearing provided within said non-rotatable section, and said second cylindrically shaped rotatable section.

19. The apparatus for automatically lowering a toilet seat in accordance with claim 18, wherein said gearing and said non-rotatable section are provided with aligned holes and a set screw is provided between said holes for securing said gearing in place, further wherein said pneumatic cylinder, said rotatable shaft and said gearing can be removed from said toilet bowl rim and disengaged from each other by removing said set screw and said means provided between said first cylindrically shaped rotatable section and said rotatable shaft.

20. The apparatus for automatically lowering a toilet seat in accordance with claim 11, wherein said means provided between said first cylindrically shaped section and said rotatable shaft is a quick release pin.

* * * * *